US005899142A

United States Patent [19]

Suda et al.

[11] Patent Number: 5,899,142

[45] Date of Patent: May 4, 1999

[54] STAMP APPARATUS WITH INK DISPERSING DEVICE

[75] Inventors: Mitsunobu Suda, Ichinomiya; Shinji Kobayashi, Nagoya, both of Japan

[73] Assignee: Brother Kogyo Kabushiki Kaisha, Nagoya, Japan

[21] Appl. No.: 08/970,753

[22] Filed: Nov. 14, 1997

[30] Foreign Application Priority Data

Nov. 20, 1996 [JP] Japan ..... 8-309022
Mar. 18, 1997 [JP] Japan ..... 9-064596

[51] Int. Cl.[6] ..... B41L 27/06

[52] U.S. Cl. ..... 101/125; 101/327

[58] Field of Search ..... 101/103, 125, 101/327, 333

[56] References Cited

U.S. PATENT DOCUMENTS

| | | | |
|---|---|---|---|
| 2,919,642 | 1/1960 | Mooney | 101/125 |
| 3,055,296 | 9/1962 | Farrow | 101/115 |
| 3,172,356 | 3/1965 | Vosburg | 101/125 |
| 3,277,819 | 10/1966 | Berkland | 101/125 |
| 3,335,660 | 8/1967 | Vosburg | 101/125 |
| 3,752,071 | 8/1973 | McKay | 101/125 |
| 3,799,053 | 3/1974 | Rabelow | 101/125 |
| 3,832,947 | 9/1974 | Funahashi | 101/327 |
| 3,886,863 | 6/1975 | Carabott et al. | 101/127.1 |

FOREIGN PATENT DOCUMENTS 7-251558 10/1995 Japan .

*Primary Examiner*—Edgar Burr
*Assistant Examiner*—Daniel J. Colilla
*Attorney, Agent, or Firm*—Oliff & Berridge, PLC

[57] ABSTRACT

A stamp apparatus includes a supporting case which supports a printing sheet, an ink supply port through which ink is fed to the second surface of the printing sheet, and a dispersing device provided between the printing sheet and the supporting case. The dispersing device disperses ink supplied from the ink supply port uniformly over the surface of the printing sheet.

12 Claims, 11 Drawing Sheets

STAMP APPARATUS WITH INK DISPERSING DEVICE

BACKGROUND OF THE INVENTION

The present invention relates to a stamp apparatus using a printing sheet.

As disclosed by Japanese Laid-Open Patent Application No. 7-251558, there is known a stamp apparatus using a porous printing sheet in which ink can be impregnated. A pattern is formed on a surface of the printing sheet, including a print portion which allows the permeation of ink and a non-print portion which block the permeation of ink. That is, ink is permeated through the printing sheet according to the pattern. The printing sheet is provided to the bottom of a body of the stamp apparatus. In order to repeatedly use the stamp apparatus without feeding ink thereto, the stamp apparatus is provided with an ink pad in which the ink is impregnated, the ink pad being interposed between the body and the printing sheet. When a user grips the body and urges the printing apparatus onto the medium so that the printing sheet is urged onto the medium, ink impregnated in the ink pad is transmitted through the printing sheet and transferred onto the medium.

However, such a stamp apparatus has a disadvantage such that the ink pad must be replaced (together with the printing sheet) when the ink impregnated therein has been used up. Such replacement increases the running cost of the stamp apparatus.

Another proposed stamp apparatus has an ink supply port (instead of the ink pad) provided in the body, through which ink can be fed to the printing sheet.

However, there is a tendency that the amount of ink fed to the location (on the printing sheet) far from the ink supply port is smaller than the amount of ink fed to the location close to the ink supply port. Accordingly, ink is not uniformly fed over an entire surface of the printing sheet, which causes a deviation of the ink density of the pattern printed on the medium.

SUMMARY OF THE INVENTION

It is therefore an object of the present invention to enhance a uniformity of the density of a printed pattern.

According to one aspect of the present invention, there is provided a stamp apparatus including a printing sheet (which selectively allows the permeation of ink according to a predetermined pattern) made of a porous sheet having first and second surfaces, a supporting case which supports the printing sheet so that the first surface is faced outside, an ink supply port (through which ink is fed to the second surface of the printing sheet) connected to the supporting case, and a dispersing device provided between the printing sheet and the supporting case. The dispersing device disperses ink supplied from the ink supply port uniformly over the second surface of the printing sheet.

With such an arrangement, since the ink supplied from the ink supply port can be dispersed by means of the dispersing device, a uniformity of density of a printed pattern is improved. Further, since the stamp apparatus does not use an ink-pad (which should be replaced every time the impregnated ink is used up), the running cost of the stamp apparatus is reduced.

In a particular arrangement, the dispersing device includes a base plate faced with the second surface of the printing sheet, and a plurality of ink holes formed on the base plate, through which ink flows to the second surface of the printing sheet. Particularly, the ink holes have different diameters so that, as the distance from the ink supply port to an ink hole increases, the diameter of the ink hole increases.

There is a tendency that the amount of ink fed to the location far from the ink supply port is smaller than the amount of ink fed to the location close to the ink supply port. However, due to the setting of the diameter of ink holes of the dispersing device, ink is uniformly fed to the surface of the printing sheet.

Further, the dispersing device includes a plurality of struts provided on the plate in such a manner that spaces are created between adjacent struts. With this, ink smoothly flows (through the spaces) to the location far from the ink supply port, which further improves the uniformity of the density of a printed pattern.

In a preferred embodiment, the stamp apparatus further includes an outer frame in which the supporting case is movable in a certain direction, and a grip provided to the outer frame with a spring member disposed therebetween. The grip is coupled with the supporting case and is movable with respect to the outer frame. The spring member urges the supporting case and the grip so that the printing sheet is retracted in the outer frame.

When the stamp apparatus is used, a user holds the grip to place the stamp apparatus on the medium. In this condition, the printing sheet is retracted in the outer frame. Then, the user urges the grip downward. The supporting case (and the printing sheet) is moved downward together with the grip, so that the printing sheet is moved to the position where the printing sheet is pressed against the medium. When the user releases the grip, the printing sheet quickly departs from the medium by the force of the spring member. Accordingly, the printing sheet quickly contacts and departs from the recording medium. It further improves the quality of the printed pattern.

In another particular arrangement, the dispersing device includes a plurality of ribs provided between the ink supply port and the printing sheet. The ribs are extended from the ink supply port toward the printing sheet. As constructed above, ink falls along the inner surface of the ink supply port onto the ribs, and further falls along the surfaces of the ribs to reach the second surface of the printing sheet. Thus, the ink is uniformly fed to the printing sheet.

Preferably, the ribs are in contact with the second surface of the printing sheet. With this, the printing sheet is supported by the ribs against the pressure when the printing sheet is urged onto the medium. Thus, the printing sheet is not loosened. The ribs are inwardly extended from an inner surface of the supporting case. Further, the ribs are integrally formed with the outer frame. Thus, the number of parts are reduced, which lowers a manufacturing cost of the stamp apparatus. Further, because of the ribs, the deformation of the outer frame (when the stamp apparatus is urged to the medium) can be prevented.

In particular, the supporting case is divided into a plurality of sections by at least one partition wall. Additionally, a plurality of ink supply ports are provided to supply ink to the plurality of sections, respectively. With such an arrangement, it is possible to use different colors of ink for respective ink supply ports, which enables a color print.

DESCRIPTION OF THE PREFERRED EMBODIMENT

A printing sheet and a stamp apparatus according to a first embodiment of the present invention are described with reference to FIGS. 1 to 5.

Figure 1:
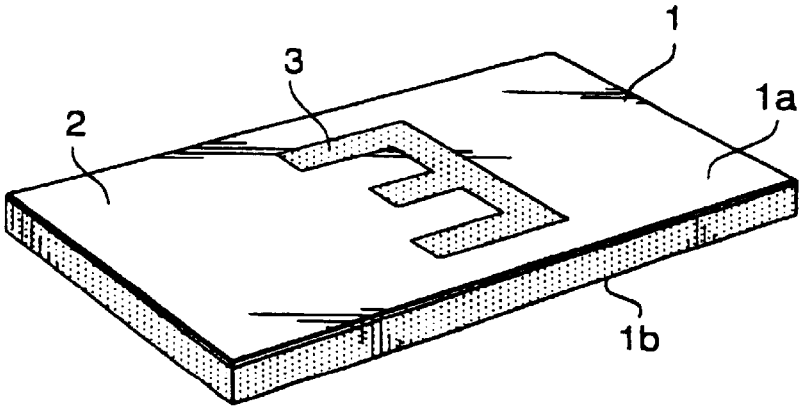
FIG. 1 is a perspective view illustrating a printing sheet.

FIG. 1 is a perspective view of a printing sheet. The printing sheet 1 is made of a porous sheet having pores in which ink can be impregnated. One surface (a print surface 1*a*) of the printing sheet 1 includes a print portion 3 and a non-print portion 2. The pores of the non-print portion 2 are sealed so as to block the permeation of ink, while the pores of the print portion 3 are not sealed so as to allow the permeation of ink. Thus, the printing sheet 1 selectively allows the permeation of ink according to a predetermined pattern ("E" in the example of FIG. 1). The printing sheet 1 has a rectangular shape.

Figure 2:
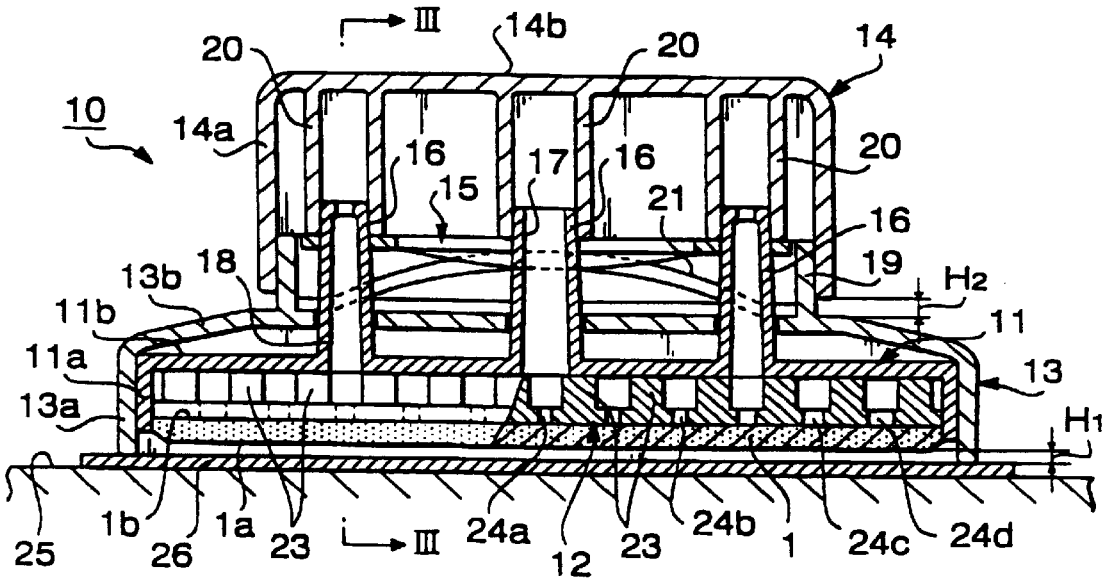
FIG. 2 is a side sectional view illustrating a stamp apparatus of the first embodiment.

FIG. 2 is a side sectional view of a stamp apparatus 10 of the first embodiment. The stamp apparatus 10 is arranged to hold the printing sheet 1 at one end portion thereof. A pattern is printed on a medium 26 (such as a paper) placed on a table 25. In the description hereinafter, the terms "tops", "bottom", "upward" and "downward" are defined at a condition where the stamp apparatus 10 is placed so that the printing sheet 1 faces the medium 26 as shown in FIG. 2.

The stamp apparatus 10 includes a supporting case 11 which supports the printing sheet 1. The supporting case 11 is a flat box-shaped case with a bottom surface opened, including a rectangular top plate 11*b* and side plates 11*a* extended downward from the periphery of the top plate 11*b*. The printing sheet 1 is fit into the supporting case 11 so that the print surface 1*a* faces downward. The four edges of the printing sheet 1 are surrounded by the side plates 11*a* of the supporting case 11. A dispersing device 12 (detailed below) is interposed between the printing sheet 1 and the top plate 11*b* of the supporting case 11.

An outer frame 13 is provided to cover and to movably support the supporting case 11. The outer frame 13 is a box-shaped case with a bottom surface opened, including a top plate 13*b* and side plates 13*a* extended downward from the periphery of the top plate 13*b*. The side plates 11*a* of the supporting case 11 is vertically slidable with respect to the inner surfaces of the side plates 13*a* of the outer frame 13, so that the supporting case 11 is vertically movable with respect to the outer frame 13. The outer frame 13 is further provided with a guide portion 19 formed on the top plate 13*b*, which is covered by a grip 14 (described below) from above.

The grip 14 is provided above the outer frame 13 with a spring unit 15 interposed therebetween. The grip 14 is cap-shaped and includes a top plate 14*b* and a skirt 14*a* extending downward from the periphery of the top plate 14*b*. When the grip 14 covers the guide portion 19 of the outer frame 13, the internal surface of the skirt 14*a* contacts the guide portion 19. In order to couple the grip 14 and the supporting case 11, three coupling members 16 are integrally provided on the top plate 11*b* of the supporting case 11, which are protruded upward through holes 18 formed on the top plate 13*b* of the outer frame 13. The grip 14 is provided with three tubular supports 20 extending downward from the top plate 14*b* of the grip 14 so that the coupling members 16 are fit into the tubular supports 20. Thus, the grip 14 is vertically slidable (together with the supporting case 11) with respect to the outer frame 13.

One of three coupling members which is located at the center of the supporting case 11 includes a vertically extending passage. The passage serves as an ink supply port 17 through which ink can be supplied to the printing sheet 1.

The spring unit 15 is provided between the bottom of the tubular support 20 and the top plate 13*b* of the outer frame 13. The spring unit 15 includes a bent plate spring 21 and urges the outer frame 13 downward with respect to the supporting case 11 and the grip 14. When no force is applied to the grip 14, the bottom end of the outer frame 13 is positioned lower than the print surface 1*a* of the printing sheet 1 (due to the force of the spring unit 15) by an amount H1 as shown in FIG. 2. Thus, the printing sheet 1 is retracted in the outer frame. The interval between the bottom end of the skirt 14*a* and the top plate 13*b* of the outer frame 13 is set to H2 which is greater than H1. When a user pushes the grip 14 downward, the grip 14 and the supporting case 11 are moved downward resisting the force of the spring unit 15, so that the printing sheet 1 can be pressed onto the medium 26.

Figure 3:
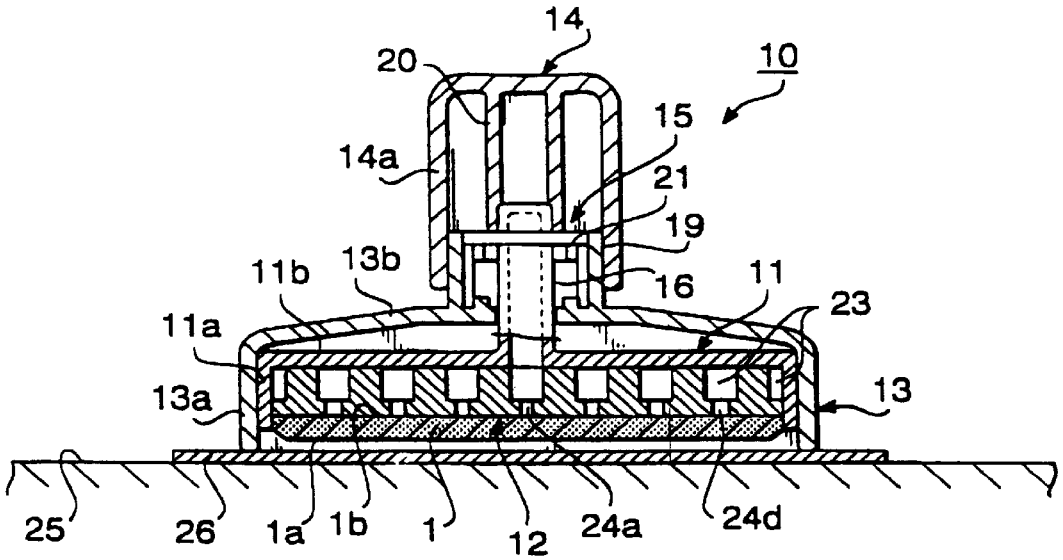
FIG. 3 is a sectional view taken along a line III—III of FIG. 2.
Figure 4:
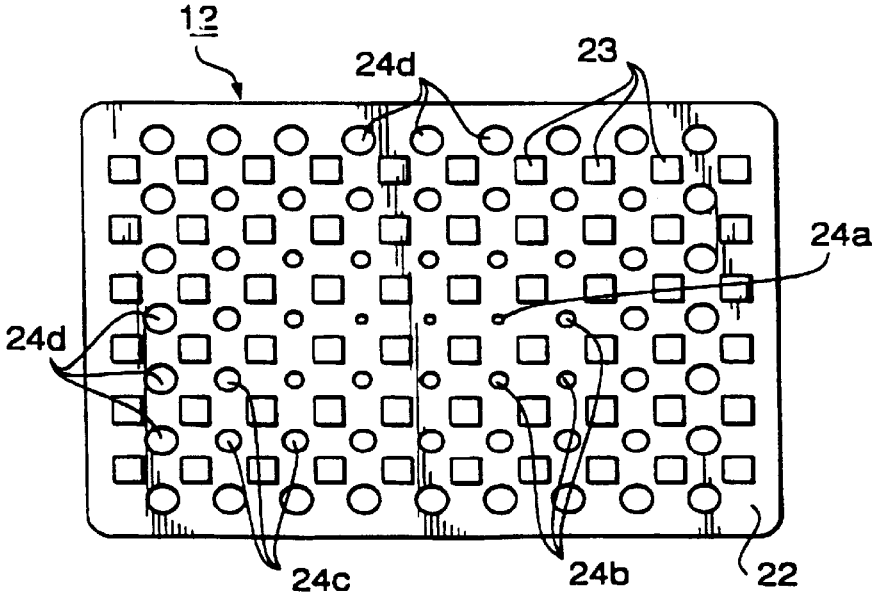
FIG. 4 is a plan view illustrating a dispersing device.
Figure 5:
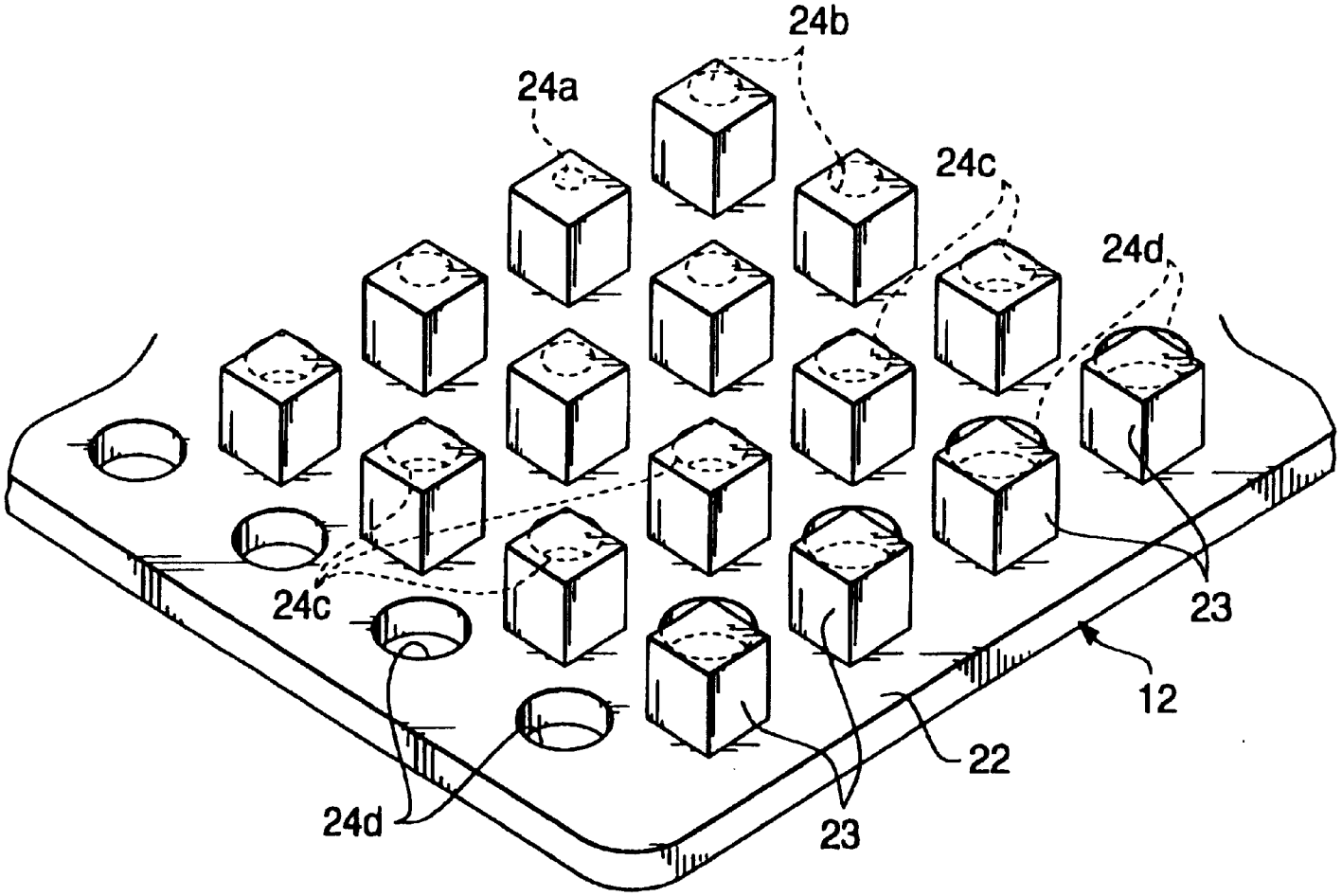
FIG. 5 is a partially cut perspective view of the dispersing device.

FIG. 3 is a sectional view of the stamp apparatus 10 taken along a line III—III of FIG. 2. FIGS. 4 and 5 are a plan view and a partially cutaway perspective view of the dispersing device 12. As shown in FIG. 3, the dispersing device 12 includes a base plate 22 which is faced with a back surface 1*b* (a surface opposite to the print surface 1*a*) of the printing sheet 1. Struts 23 are provided on the base plate 22 at a predetermined interval, which are protruded upward toward the top plate 11*b* of the supporting case 11. As shown in FIG. 5, spaces are created between adjacent struts 23 and between the top plate 11*b* and the base plate 22. The spaces are connected with each other.

As shown in FIG. 4, the base plate 22 is provided with ink holes 24*a*, 24*b*, 24*c* and 24*d* which penetrate the base plate 22 and open in the spaces between respective struts 23. The ink supplied onto the upper surface of the base plate 22 is transmitted to the back surface 1*b* of the printing sheet 1 through the ink holes 24*a*, 24*b*, 24*c* and 24*d*. Further, the ink holes 24*a*, 24*b*, 24*c* and 24*d* have different diameters so that, as the distance from the ink supply port 17 increases, the diameter of the ink hole increases. In particular, the ink hole 24*a* is located at the closest position to the ink supply port 17, with ink hole 24*b*, 24*c* and 24*d* following in that order. The ink hole 24*d* has the largest diameter, with the ink hole 24*c*, 24*b* and 24*a* following in that order. There is a tendency that the amount of ink fed to the location far from the ink supply port 17 is smaller than the amount of ink fed to the location close to the ink supply port 17. However, due to the setting of the diameter of the ink holes 24*a*, 24*b*, 24*c* and 24*d*, ink is uniformly fed to the back surface 1*b* of the printing sheet.

As constructed above, ink supplied from the ink supply port 17 is uniformly fed to the back surface 1*b* of the printing sheet 1 (through the ink holes 24*a*, 24*b*, 24*c* and 24*d*) and is uniformly impregnated in the printing sheet 1.

When the stamp apparatus 10 is used, a user holds the grip 14 to place the stamp apparatus 10 on the medium 26 and pushes the grip 14 downward. The movement of the grip 14 moves the supporting case 11 (and the printing sheet 1) downward resisting the force of the spring unit 15, so that the printing sheet 1 is pressed against the surface of the medium 26. When the user releases the grip 14, the printing sheet 1 quickly departs from the medium 26. Accordingly, the printing sheet 1 quickly contacts and departs from the medium 26.

Since ink is uniformly impregnated in the printing sheet 1, ink is uniformly transmitted on the medium 26. Accordingly, the density of the pattern formed on the medium 26 becomes uniform. Particularly, the blur of the periphery of the pattern can be prevented. Further, because of the spaces between the struts 23, ink supplied from the ink supply port 17 is smoothly fed to the location far from the ink supply port 17. Thus, the uniformity of the density of the pattern is further improved.

In the first embodiment, the above described components of the stamp apparatus 10 can be made of a synthetic resin. Further, it is possible to divide the space (on the base plate 22) into several sections and to provide several ink supply ports for respective sections. It enables color print, by using inks of several colors in respective sections. It is further possible to replace the spring unit 15 with a coil spring provided around the coupling member 16. Further, it is possible to provide through holes penetrating the top plate 11*b* of the supporting case 11 and to use the through holes instead of the ink supply port 17. Further, the stamp apparatus can be constructed by providing a grip 14 to the upper surface of the top plate 11*b* of the supporting case 11, without the outer frame 13 and the spring unit 15. Additionally, a detachable cover (not shown) can be provided to the lower end of the outer frame 13 or the supporting case 11 to cover the print surface 1*a* of the printing sheet 1.

The second embodiment of the present invention is described.

Figure 6:
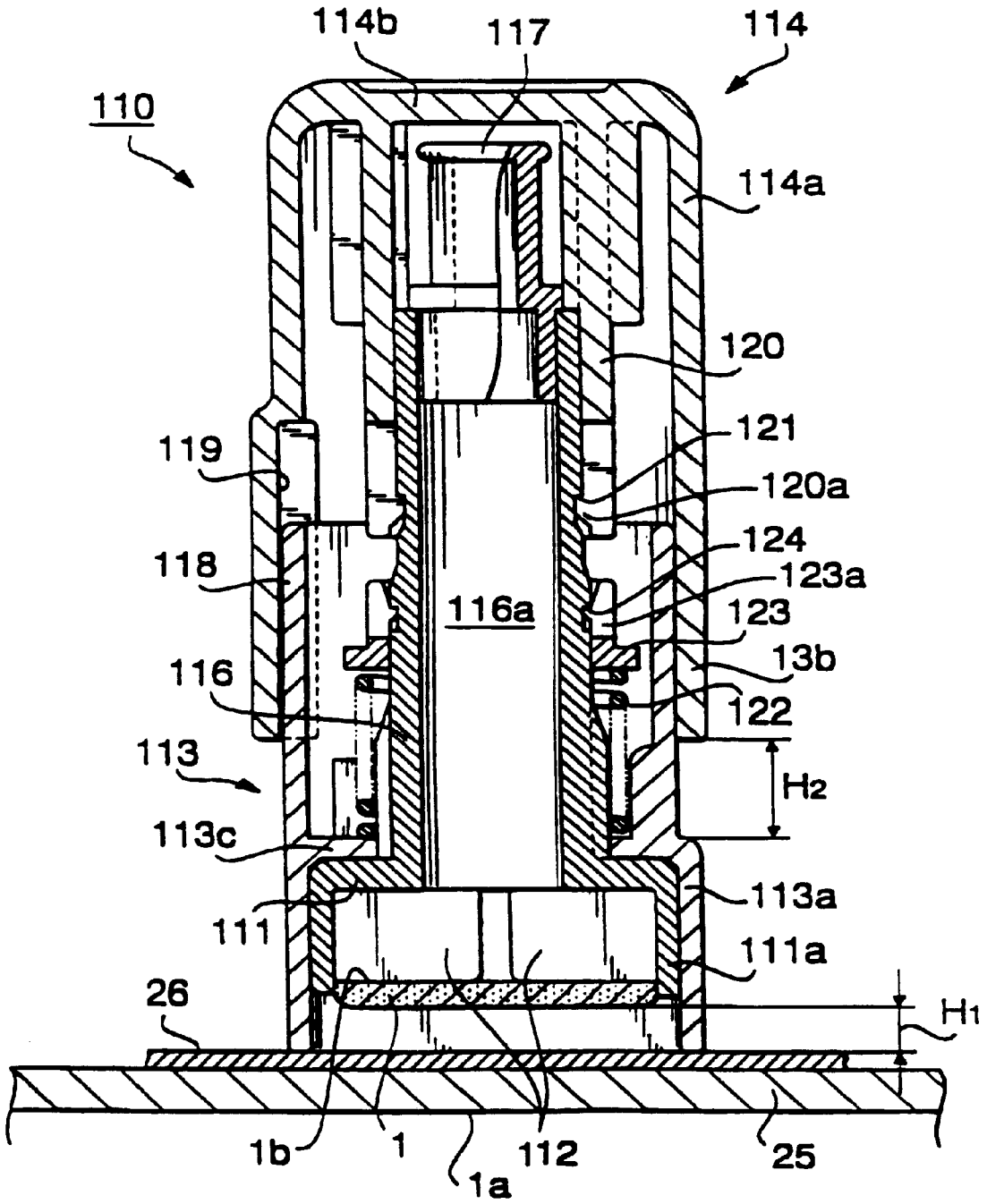
FIG. 6 is a side sectional view of the stamp apparatus of a second embodiment.

FIG. 6 is a sectional view of the stamp apparatus 110 of the second embodiment. The stamp apparatus 110 uses the printing sheet 1 having a circular shape. The features of the printing sheet 1 except its shape are the same as the printing sheet 1 described in the first embodiment.

The stamp apparatus 110 includes a cylindrical supporting case 111 with a bottom surface opened, including a circular top plate 111*b* and a skirt portion 111*a* extending downward from the circumference of the top plate 111*b*. The printing sheet 1 is fit into the bottom of the supporting case 111 so that the gap between the periphery of the printing sheet 1 and the skirt portion 111*a* is sealed. Dispersing ribs 112 (detailed later) are formed in the supporting case 111. An outer frame 113 is provided to support the supporting case 111 from outside. The outer frame 113 has a tubular shape, including upper and lower cylinder portions 113*b* and 113*a* respectively. The supporting case 111 is vertically slidable in contact with the inner surface of the lower cylinder portion 113*a*.

An ink supply port 116 is provided to the supporting case 111. The ink supply port 116 is a cylindrical member integrally formed in line with the supporting case 111, and surrounded by the upper cylinder portion 113*b*. The ink supply port 116 is provided with a passage 116*a* which opens at both ends. The upper end of the passage 116*a* is closed by a lid 117. When the lid 117 is removed, ink can be supplied to the supporting case 111 through the passage 116*a*.

A grip 114 is provided above the outer frame 113. The grip 114 is cap-shaped and includes a top plate 114*b* and a skirt 114*a* extending downward from the periphery of the top plate 114*b*. The skirt 114*a* is in contact with the upper cylinder portion 113*b*. In order to prevent the rotation of the grip 114 with respect to the outer frame 113, the outer frame 113 is provided with a bar 118 which engages a vertically extending groove 119 provided to the inner surface of the grip 114. In order to detachably mount the grip 114 to the supporting case 111, the grip 114 is provided with a tubular support 120 extending downward from the top plate 114*b*. The tube 120 is provided with projections 120*a* inwardly projecting from the inner surface thereof. Each projection 120*a* elastically engages with a recess 121 formed at the outer surface of the ink supply port 116.

A coil spring 122 is interposed between the outer surface of the ink supply port 116 and an inner surface of the upper cylinder portion 113*b* of the outer frame 113. The upper end of the coil spring 122 abuts an upper stopper 123 provided around the ink supply port 116. The lower end of the coil spring 122 abuts a lower stopper 113*c* provided to the outer frame 113. That is, the coil spring 122 urges the outer frame 113 downward with respect to the ink supply port 116 and the supporting case 111. Thus, when no force is applied to the grip 114, the supporting case 111 are lifted up with respect to the outer frame 113 so that a bottom end of the lower cylinder portion 113*a* of the outer frame 113 is lower than the print surface 1*a* of the printing sheet 1 (by a distance H1). Thus, the printing sheet 1 is retracted in the outer frame 113. The interval between the bottom end of the skirt portion 114*a* and the upper cylinder portion 113*b* of the outer frame 113 is set to H2 which is greater than H1.

When a user pushes the grip 114 downward, the supporting case 111 and the ink supply port 116 are moved downward resisting the force of the coil spring 122, so that the printing sheet 1 can be pressed against the surface of the medium 26. When the user releases the grip 114, the printing sheet 1 quickly departs from the medium 26. Accordingly, the printing sheet 1 quickly contacts and departs the medium 26.

Figure 8:
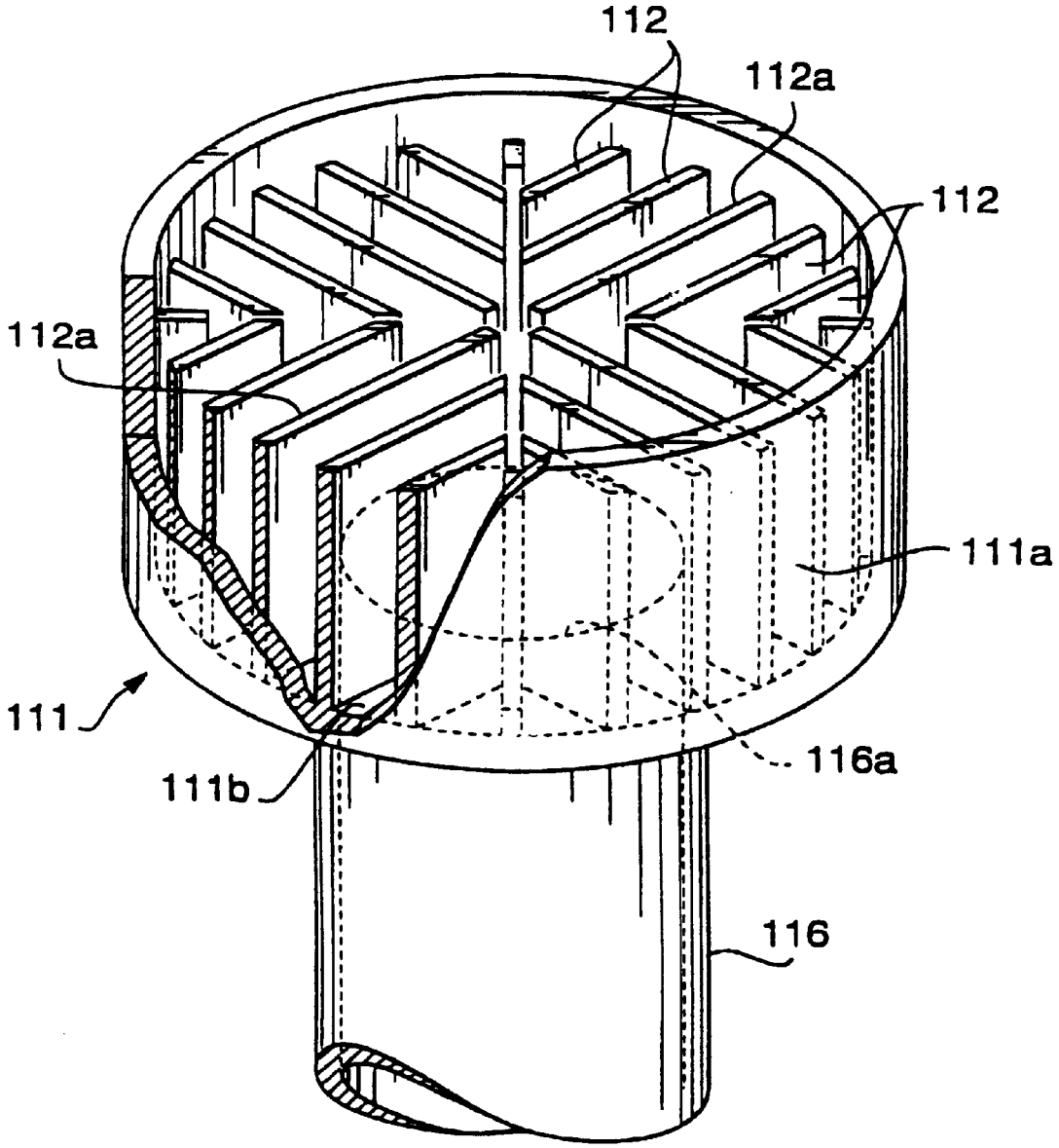
FIG. 8 is a perspective view of a dispersing ribs and a supporting case of the stamp apparatus of FIG. 6.
Figure 9:
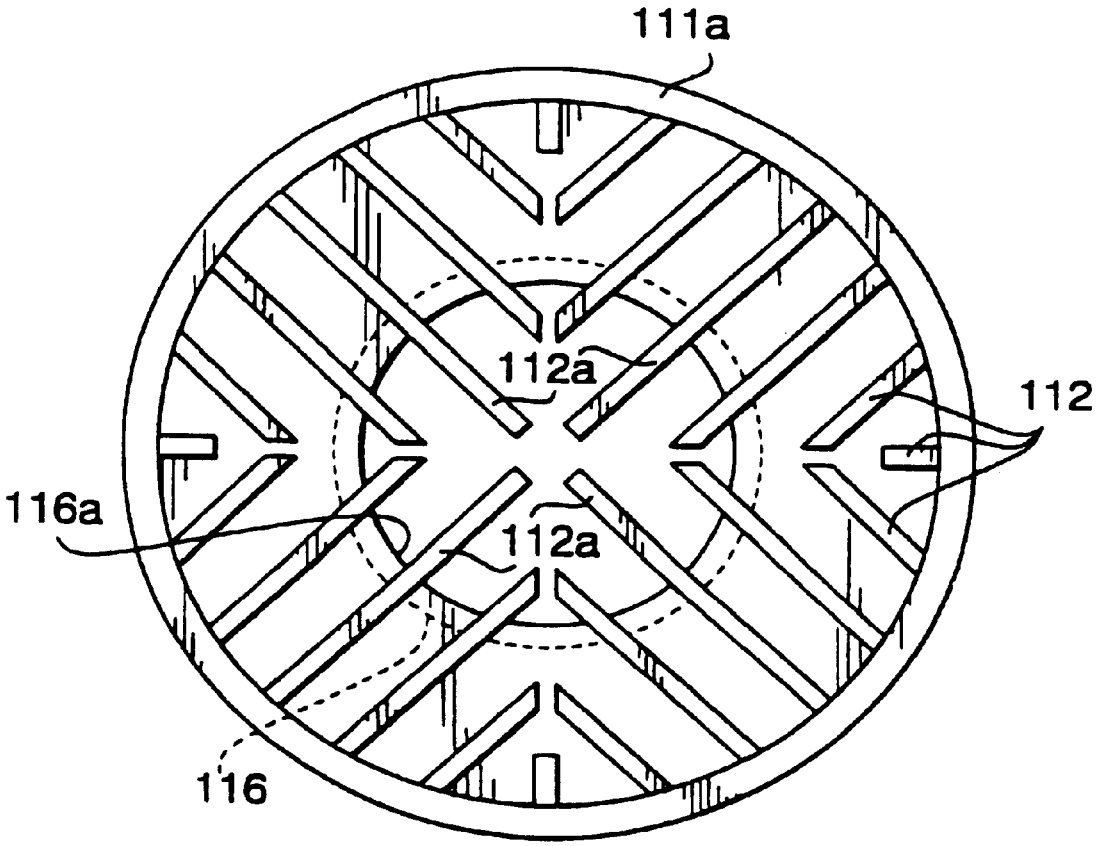
FIG. 9 is a plan view of the supporting case and the dispersing ribs of FIG. 8.

FIGS. 8 and 9 are a bottom perspective view and a bottom view of the supporting case 111 and the dispersing ribs 112. The dispersing ribs 112 are inwardly extended from an inner surface of the skirt portion 111*a* of the supporting case 111. Further, the dispersing ribs 112 are extended from the top plate 111*b* of the supporting case 111 toward the printing sheet 1. The lower ends of the dispersing ribs 112 are in contact with the back surface 1*b* of the printing sheet 1 (FIG. 6). As shown in FIG. 9, several dispersing ribs 112*a* are extended to a portion below the lower end of the passage 116*a* of the ink supply port 116. The periphery of the printing sheet 1 is adhered to the skirt portion 111*a* by means of adhesive or heat press. Particularly, the supporting case 111 is made of acrylonitrile-butadienestyrene (ABS) plastic and the printing sheet 1 is made of urethane plastic, so that the supporting case 111 and the printing sheet 1 can be well adhered by means of heat-press. A vertical gap between the print surface 1*a* of the printing sheet 1 and the bottom end of the skirt portion 111*a* of the supporting case 111 is set to approximately 0.5 mm. With this, when the printing sheet 1 is urged to the medium 26, a heat-pressed portion of the printing sheet 1 does not suffer from a large amount of deformation, which improves the durability of the printing sheet 1. Further, it is possible to adhere the bottom ends of several dispersing ribs 112 to the back surface of the printing sheet 1 by means of an adhesive, so that printing sheet 1 are not peeled off from the dispersing ribs 112.

On supplying ink to the stamp apparatus 110, the grip 114 is detached from the supporting case 111 and the lid 117 is removed from the ink supply port 116. Then, ink is poured from the upper end of the passage 116*a* of the ink supply port 16. Ink falls along the inner surface of the passage 116*a* onto the dispersing ribs 112, and further falls along the surfaces of the dispersing ribs 112. Finally, ink reaches to the back surface 1*b* of the printing sheet 1 and is impregnated in the printing sheet 1.

Figure 7:
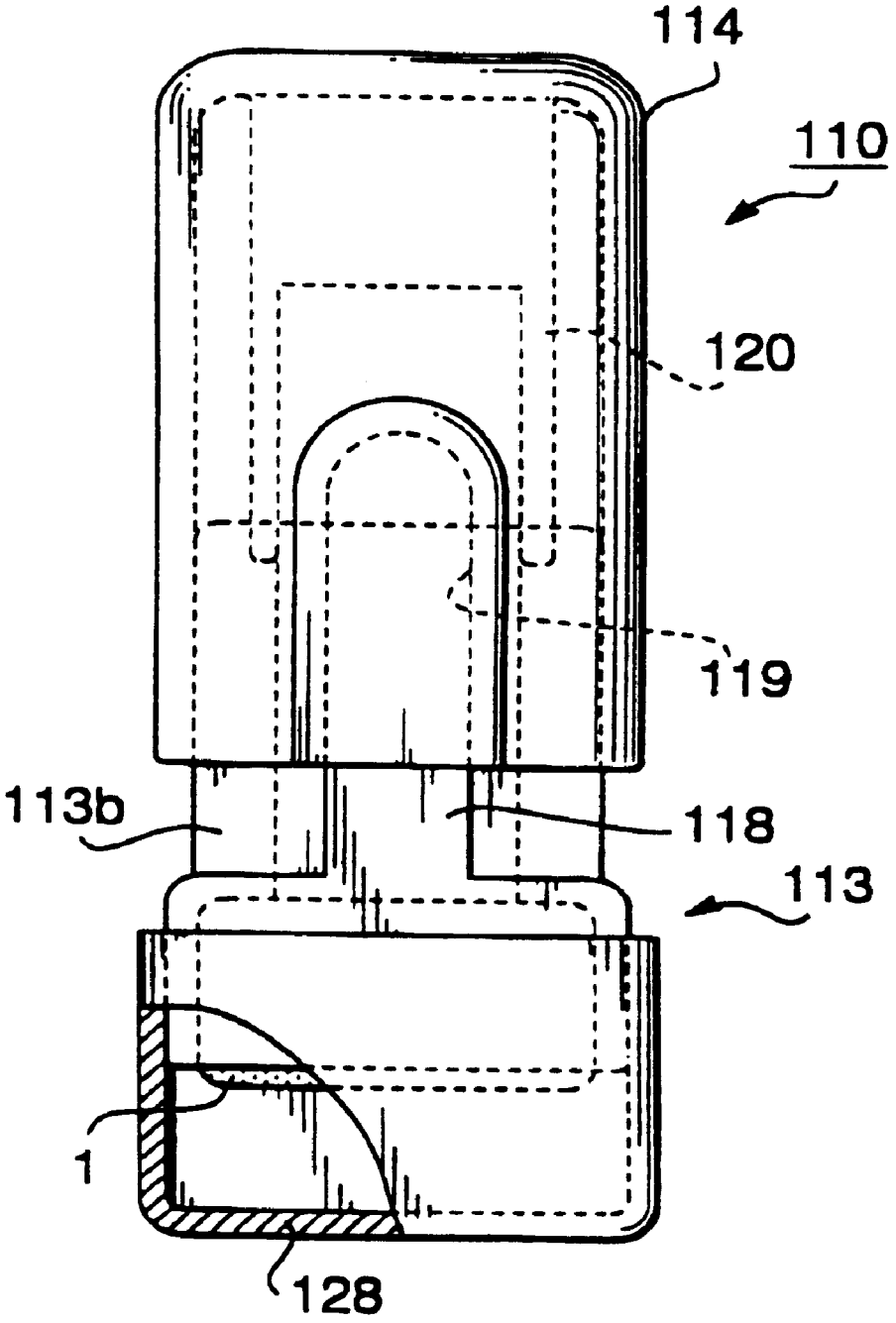
FIG. 7 is a side view of the stamp apparatus of FIG. 6.

As constructed above, the ink is uniformly fed over entire surface of the printing sheet 1. Further, since the dispersing ribs 112 exist behind the printing sheet 1, the printing sheet 1 is not loosened. Further, because of the dispersing ribs 112, the deformation of the outer frame 113 (when the stamp apparatus 110 is pressed to the medium 26) can be prevented. It is preferable that a detachable cover 128 (FIG. 7) is provided to the lower end of the outer frame 113 or the supporting case 111 to cover the printing surface 1*a* of the printing sheet 1.

Figure 10:
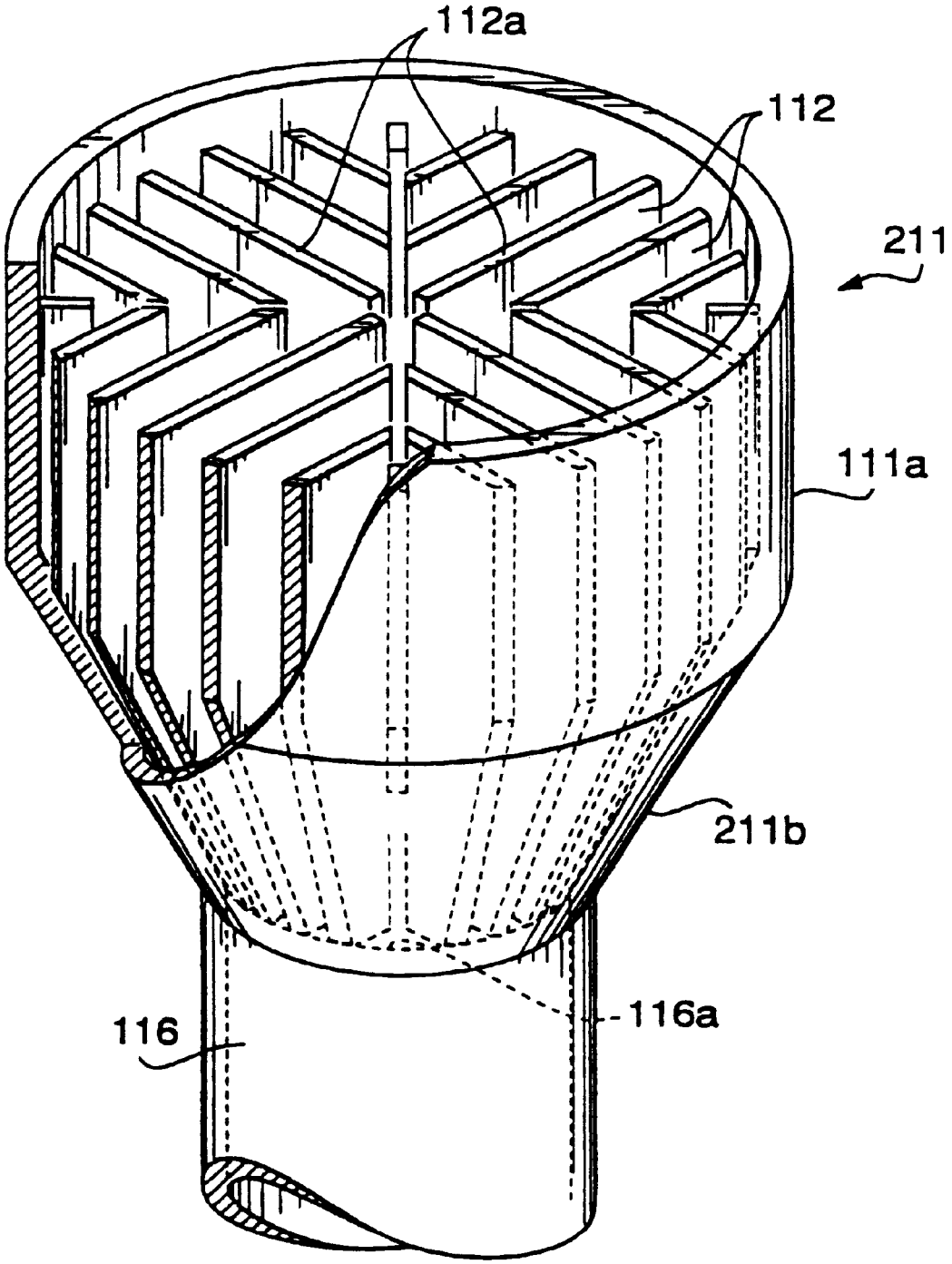
FIG. 10 is a perspective view of a modification of the supporting case of the second embodiment.

FIG. 10 shows a modification of the supporting case of the second embodiment. In a supporting case 211 of the modification, a trapezoid wall 211*b* is provided between the skirt portion 111*a* and the ink supply port 116, instead of top plate 111*b*. Accordingly, ink (which has fallen along the inner wall of the passage 116*a*) easily falls downward along the trapezoid wall 211*b*. Thus, the ink is quickly and uniformly fed to the printing sheet 1.

The third embodiment of the present invention is described.

Figure 11:
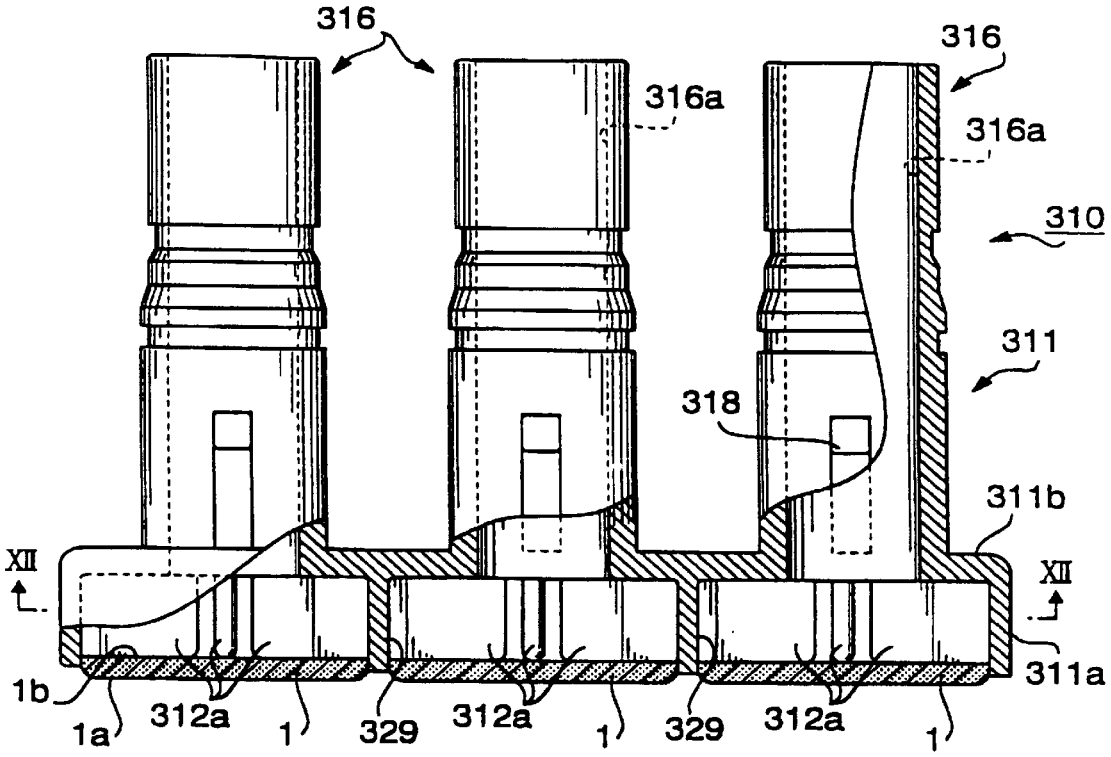
FIG. 11 is a side sectional view of a supporting case of the third embodiment.
Figure 12:
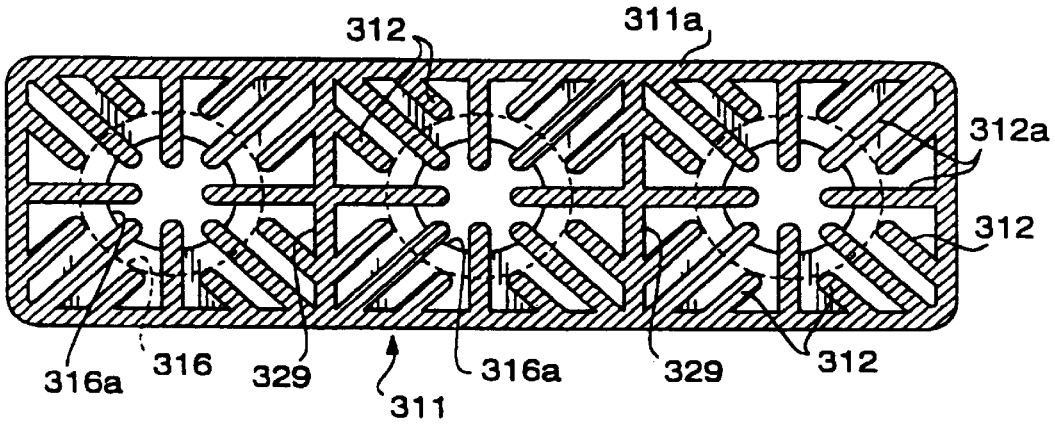
FIG. 12 is a sectional view taken along a line XII—XII of FIG. 11.
Figure 13:
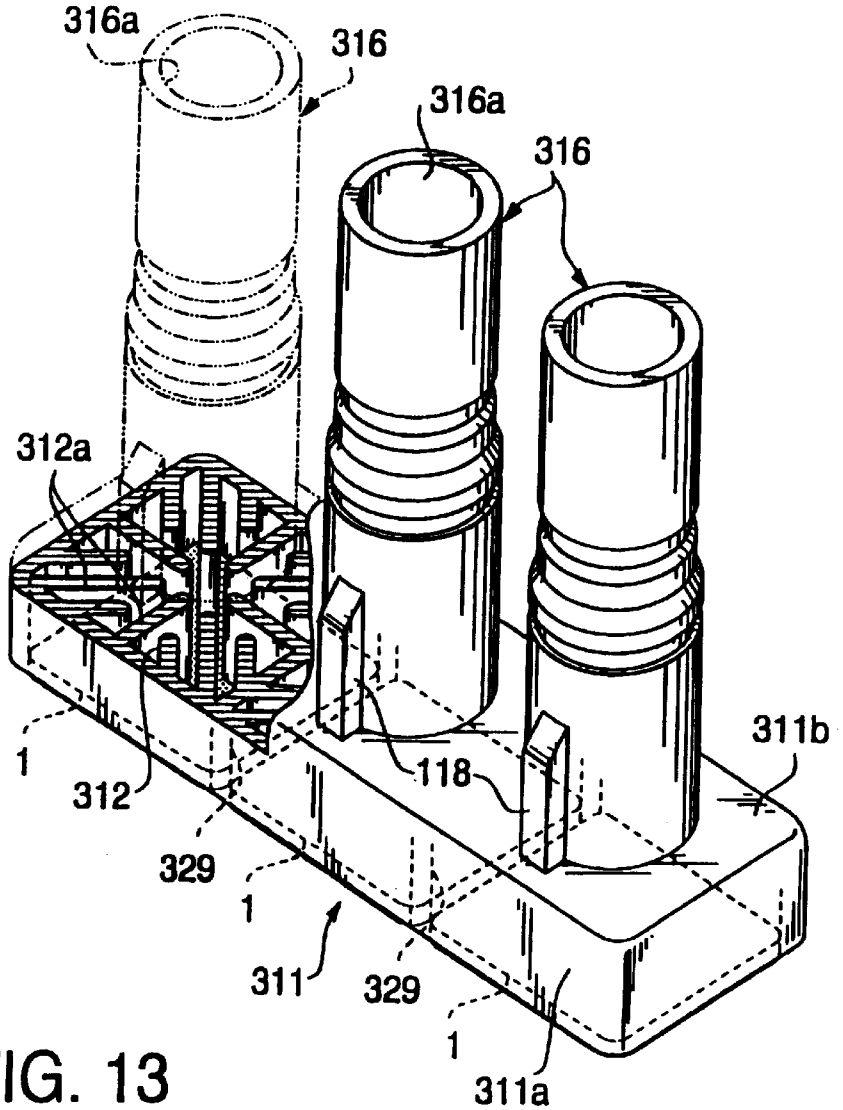
FIG. 13 is a perspective view of a supporting case of the third embodiment.

FIGS. 11, 12 and 13 are a side view, a bottom view and a perspective view of a stamp apparatus 310 of the third embodiment. Although a grip is omitted in FIGS. 11, 12 and 13, the grip is constructed in a substantially similar manner to the grip 114 of the second embodiment. The stamp apparatus 310 includes a square shaped supporting case 311, including a top plate 311*b* and side plates 311*a* extending downward from the periphery of the top plate 311*b*. A cavity defined by the top plate 311*b* and side plates 311*a* is divided into three sections by two partition walls 329. Three ink supply ports 316 are respectively provided to the three sections of the supporting case 311. Each ink supply port 316 is constructed in a similar manner to the ink supply port 116 of the second embodiment and has a passage 316*a* with both ends opened. The top end of the passage 316*a* is closed by a lid (not shown) which is similar to the lid 117 (FIG. 6) of the second embodiment.

As shown in FIGS. 12 and 13, dispersing ribs 312 are respectively provided in the three sections of the supporting case 311. In each section, dispersing ribs 312 extend from the side plates 311*a* and the partition 329 toward the center of the section. The bottom ends of the dispersing ribs 312 are in contact with the top surface of the printing sheet 1 (FIG. 11). As shown in FIG. 12, several dispersing ribs 312*a* are extended to a portion below the lower end of the passage 316*a* of the ink supply port 316. As shown in FIG. 11, three printing sheets 1 are provided to the respective sections of the supporting case 311.

As constructed above, the ink is quickly and uniformly fed to the printing sheet 1. Further, since the ink of respective sections do not mix with each other, it is possible to use different colors of ink for respective ink supply ports 316, which enables a color print.

Figure 14:
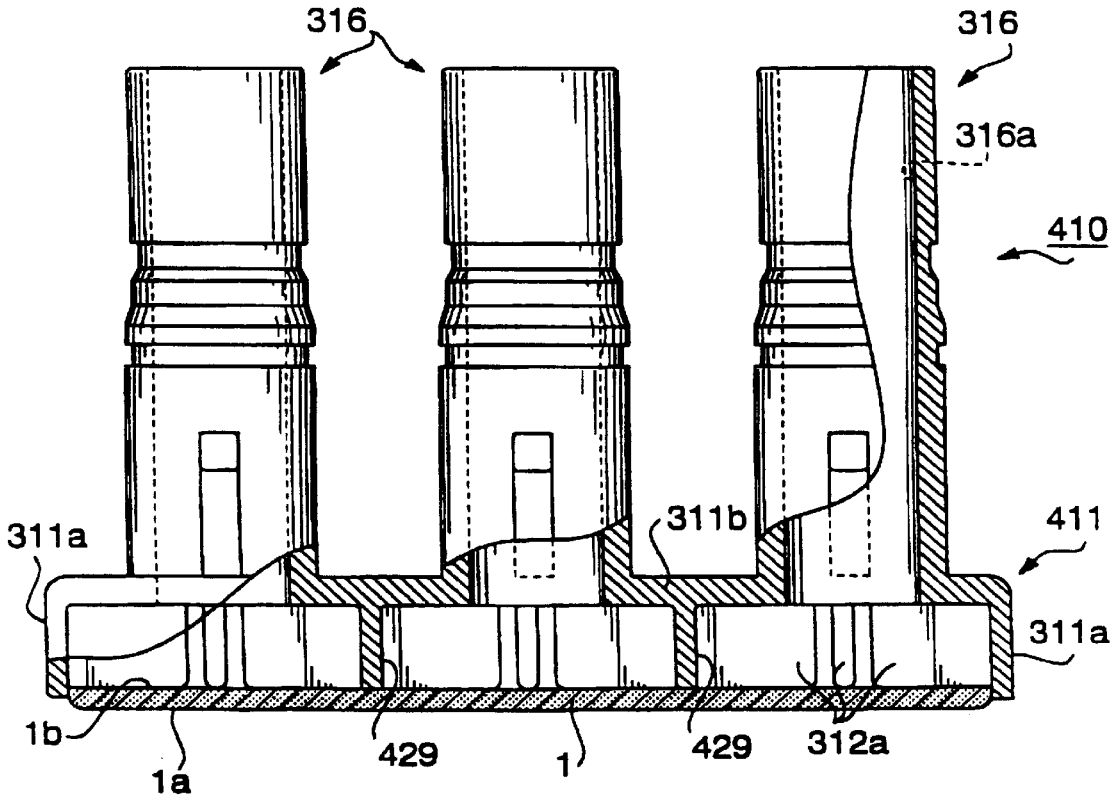
FIG. 14 is a side sectional view of a supporting case of a modification of the third embodiment.

FIG. 14 is a side view of a modification of the stamp apparatus of the third embodiment. In the stamp apparatus 410, the supporting case 411 is divided into three sections by two partition walls 429. However, one printing sheet 1 is provided to the supporting case 411 so that the printing sheet 1 covers the lower ends of all sections thereof. The printing sheet 1 is adhered to the side plates 311*a* by means of an adhesive or heat-press. It is preferred that the bottom end of each partition 429 is in contact with and adhered to the upper surface of the printing sheet 1. With such an arrangement, if ink of one color is supplied to the ink supply ports 316, a large pattern can be obtained. Further, if different colors of ink are used for respective ink supply ports 316, color image can be obtained.

In the second and third embodiments, it is possible that the supporting case 111 (or 311) is made of synthetic resin and manufactured by injection molding. With this, it becomes easy to integrally manufacture the supporting case 111 (or 311) and the dispersing ribs 112. Furthermore, the stamp apparatus can be constructed by providing the grip 114 to the upper surface of the top plate 111*b* of the supporting case 111 (or 311), without the outer frame 113 and the spring unit 15. It is further possible to provide through holes penetrating the top plate 111*b* of the supporting case 111 and to use the through holes instead of the ink supply port 116.

Finally, a manufacturing process of the printing sheet 1 is briefly described. The printing sheet 1 is manufactured by a not shown manufacturing device provided with a flash bulb capable of irradiating infrared rays. A porous sheet (in which ink can be impregnated) is used as a base material of the printing sheet. A black film having a surface coated with carbon is used to heat the surface of the porous sheet. An original sheet is made of a material which allows the permeation of infrared rays, while a pattern (such as a character, figure, or the like) is formed by a material which blocks infrared rays.

The porous sheet, the black film and the original sheet are overlapped and laid on a transparent plate. The overlapped sheets are pressed so that the porous sheet contacts the black film and the black film contacts the original sheet. Then, the flash bulb irradiates infrared rays to the original sheet through the transparent plate. Infrared rays irradiated onto the pattern on the original sheet are blocked, whereas infrared rays irradiated onto non-pattern portion pass through the original sheet. The infrared rays passing through the original sheet reach the black film causing the black film to generate heat. The heated surface of the porous sheet is caused to melt such that pores near the surface thereof are sealed. Conversely, since the infrared rays are blocked by the pattern of the original sheet, the portion of the black film which corresponds to the pattern does not generate heat, so that the pores near the surface of the porous sheet corresponding thereto are not sealed.

Thus, a print portion 3 in which pores are opened and a non-print portion 2 in which pores are sealed are formed on the surface of the porous sheet as shown in FIG. 1. With such a process, the printing sheet 1 is formed.

It is alternatively possible to disperse carbon grains or other material (for example, silver chloride or silver bromide) which absorbs infrared rays. The porous sheet can be made of a foamed resin made of polyolefin resin, polyvinyl chloride resin, polyurethane resin or other material which shows flexibility and softness when formed into the porous sheet. Pores are disposed over a surface of the porous sheet (before the pattern is formed on the surface of the porous sheet). Particularly, the thickness of the porous sheet is 1 to 5 mm. When such porous sheet is overlapped with the original sheet and exposed to the infrared rays irradiated through the original sheet, the porous sheet absorbs infrared rays and generates heat itself. Thus, it is not necessary to provide a black film. It is preferred that the content of the carbon in the porous resin sheet 38 is in the range of 0.01–15 wt %. With this, the porous resin sheet is gray and, when heated, turns black. Accordingly, it can be confirmed which of various colors of ink has been impregnated in the porous resin sheet. Further, since the carbon is greater than or equal to 0.01 wt %, the porous resin sheet is easily heated (such that the pores at the surface thereof are sealed) by a standard flash bulb.

The original sheet is made of a material (such as a copy paper) which allows the permeation of light, on which a pattern is formed using ink or paint which blocks the transmission of light. The porous sheet is overlapped with the original sheet with a transparent film sandwiched therebetween. The transparent film is made of a material having a high melting point and the thickness thereof is 0.025 to 0.2 mm. The porous sheet, the transparent film and the original sheet are overlapped and laid on the transparent plate so that the pattern on the surface of the original sheet contacts the transparent film. Then, the flash bulb irradiates infrared rays to the original sheet through the transparent plate. Infrared rays irradiated onto the pattern on the original sheet are blocked, whereas infrared rays irradiated onto non-pattern portion pass through the original sheet. The infrared rays passing through the original sheet reach the porous sheet, causing the carbon black to generate heat. The heated portion melts such that pores thereof are sealed. Conversely, since the infrared rays are blocked by the pattern of the original sheet, the portion of the porous sheet which corresponds to the pattern does not generate heat, so that the pores of the porous sheet corresponding thereto are not sealed. Thus, the print sheet 1 is formed. In the above described process, the pattern on the original sheet tends to be heated by the irradiation of the infrared rays. However, since the heat of the pattern of the original sheet is dispersed in the transparent film, the heat of the pattern of the original sheet does not affect the porous sheet to melt.

Although the structure of a stamp apparatus is described herein with respect to the preferred embodiments, many modifications and changes can be made without departing from the spirit and scope of the invention.

The present disclosure relates to subject matter contained in Japanese Patent Application Nos. HEI 8-309022, filed on Nov. 20, 1996 and HEI 09-64596, filed on Mar. 18, 1997, which are expressly incorporated herein by reference in its entirety.

What is claimed is:

1. A stamp apparatus, comprising:

a printing sheet made of a porous sheet having first and second surfaces, which selectively allows the permeation of ink therethrough according to a predetermined pattern, said printing sheet including:

a print portion formed on said first surface, which allows the permeation of ink; and a non-print portion formed on said first surface, which blocks the permeation of ink, said print portion and said non-print portion being formed according to a predetermined pattern;

a supporting case which supports said printing sheet, with said first surface faced outside so that said first surface is able to urge against a medium;

an ink supply port connected to said supporting case, through which ink is fed to said second surface of said printing sheet; and a dispersing device provided between said printing sheet and said supporting case, said dispersing device including:

a base plate faced with said second surface of said printing sheet; and a plurality of ink holes formed on said base plate, through which ink flows to said second surface of said printing sheet, said ink holes having different diameters so that, as the distance from the ink supply port to said ink holes increases, the diameter of said ink holes increases, wherein said dispersing device disperses ink supplied from said ink supply port uniformly over said second surface of said printing sheet.

2. A stamp apparatus according to claim 1, wherein said dispersing device includes a plurality of struts provided on said base plate in such a manner that spaces are created between adjacent struts.

3. A stamp apparatus according to claim 1, further comprising:

an outer frame in which said supporting case is movably supported; and a grip provided to said outer frame with a spring member disposed therebetween, said grip being coupled with said supporting case and being movable with respect to said outer frame, and wherein said spring member urges said supporting case and said grip so that said printing sheet is retracted in said outer frame.

4. A stamp apparatus, comprising:

a printing sheet made of a porous sheet having first and second surfaces, which selectively allows the permeation of ink therethrough according to a predetermined pattern, said printing sheet including:

a print portion formed on said first surface, which allows the permeation of ink; and a non-print portion formed on said first surface, which blocks the permeation of ink, said print portion and said non-print portion being formed according to a predetermined pattern;

a supporting case which supports said printing sheet, with said first surface faced outside so that said first surface is able to urge against a medium;

an ink supply port connected to said supporting case, through which ink is fed to said second surface of said printing sheet; and a dispersing device provided between said printing sheet and said supporting case, wherein said dispersing device disperses ink supplied from said ink supply port uniformly over said second surface of said printing sheet and includes a plurality of ribs provided between said ink supply port and said printing sheet, said plurality of ribs extend from said ink supply port toward said printing sheet and are in contact with said second surface of said printing sheet.

5. The stamp apparatus according to claim 4, wherein said plurality of ribs are inwardly extended from an inner surface of said outer frame.

6. The stamp apparatus according to claim 5, wherein said ribs are integrally formed with said supporting case.

7. The stamp apparatus according to claim 6, wherein said outer frame and said ink supply port have cylindrical shapes and are provided in line with each other.

8. The stamp apparatus according to claim 4, wherein said supporting case is divided into a plurality of sections by at least one partition wall, wherein a plurality of ink supply ports are provided to supply ink to said plurality of sections, respectively.

9. The stamp apparatus according to claim 8, wherein a plurality of printing sheets are provided to said plurality of sections of said supporting case, respectively.

10. The stamp apparatus according to claim 8, wherein one printing sheet is provided to said supporting case so that said printing sheet covers said plurality of sections.

11. A stamp apparatus according to claim 4, further comprising:

an outer frame in which said supporting case is movably supported; and a grip provided to said outer frame with a spring member disposed therebetween, said grip being coupled with said supporting case and being movable with respect to said outer frame, and wherein said spring member urges said supporting case and said grip so that said printing sheet is retracted in said outer frame.

12. The stamp apparatus according to claim 4, said printing sheet comprising:

said print portion formed on said first surface, which allows the permeation of ink; and said non-print portion formed on said first surface, which blocks the permeation of ink, said print portion and said non-print portion being formed according the predetermined pattern.

* * * * *